US006036353A

United States Patent [19]

Paetzold

[11] Patent Number: 6,036,353

[45] Date of Patent: Mar. 14, 2000

[54] METHOD OF CONTROLLING A MOBILE PUGMILL HAVING A WEIGHT METERING CONTROL SYSTEM

[75] Inventor: John Paetzold, Amarillo, Tex.

[73] Assignee: Excel Machinery Company, Inc., Amarillo, Tex.

[21] Appl. No.: 09/250,961

[22] Filed: Feb. 16, 1999

Related U.S. Application Data

[62] Division of application No. 08/593,408, Jan. 29, 1996, Pat. No. 5,873,653.

[51] Int. Cl.[7] ..... B28C 7/04

[52] U.S. Cl. ..... 366/8

[58] Field of Search ..... 366/1, 2, 6, 8, 366/16–18, 20, 27–29, 33–35, 37, 38, 40, 50, 141, 151.1, 152.1, 186, 606

[56] References Cited

U.S. PATENT DOCUMENTS

| | | |
|---|---|---|
| 517,724 | 4/1894 | Beers . |
| 2,115,110 | 4/1938 | Keil . |
| 2,366,222 | 1/1945 | Tocci-Guilbert . |
| 2,703,649 | 3/1955 | Cheyette . |
| 2,864,561 | 12/1958 | Mork . |
| 3,322,354 | 5/1967 | Ostermann et al. . |
| 3,625,488 | 12/1971 | Farnham et al. . |
| 3,661,365 | 5/1972 | Cloud, Jr. . |
| 3,945,619 | 3/1976 | Taibi . |
| 4,204,773 | 5/1980 | Bates . |
| 4,218,145 | 8/1980 | Brock et al. . |
| 4,222,498 | 9/1980 | Brock . |
| 4,256,572 | 3/1981 | Read . |
| 4,334,784 | 6/1982 | Engels . |
| 4,363,725 | 12/1982 | Morita et al. . |
| 4,406,548 | 9/1983 | Haws . |
| 4,775,275 | 10/1988 | Perry . |
| 4,792,234 | 12/1988 | Doherty . |
| 4,861,461 | 8/1989 | Utterback . |
| 4,881,819 | 11/1989 | Blees . |
| 4,956,078 | 9/1990 | Magerowski et al. . |
| 4,983,280 | 1/1991 | Eriksson . |
| 5,044,819 | 9/1991 | Kilheffer et al. . |
| 5,097,610 | 3/1992 | Bishop . |
| 5,100,537 | 3/1992 | Krause . |
| 5,120,433 | 6/1992 | Osadchuk . |
| 5,423,606 | 6/1995 | Milstead . |
| 5,667,298 | 9/1997 | Musil et al. . |
| 5,873,653 | 2/1999 | Paetzold . |

FOREIGN PATENT DOCUMENTS

| | | |
|---|---|---|
| 693345 | 10/1979 | U.S.S.R. . |
| 488026A | 6/1989 | U.S.S.R. . |
| 1553667 | 10/1979 | United Kingdom . |

*Primary Examiner*—Charles E. Cooley
*Attorney, Agent, or Firm*—David H. Judson

[57] ABSTRACT

A portable chassis-mounted continuous flow, blending and mixing plant utilizing a Programmable Logic Controller and belt scales to continuously meter and adjust the flow of aggregate as well as maintain the proper ratio and flow of additives, both dry and liquid.

9 Claims, 2 Drawing Sheets

METHOD OF CONTROLLING A MOBILE PUGMILL HAVING A WEIGHT METERING CONTROL SYSTEM

This is a divisional of application Ser. No. 08/593,408 filed on Jan. 29, 1996, now U.S. Pat. No. 5,873,653.

TECHNICAL FIELD

The present invention relates to a portable blending and mixing plant or "pugmill" that provides an homogenous blending and mixture of various aggregates and additives.

BACKGROUND OF THE INVENTION

Known portable mixing plants for producing asphalt and the like do not consistently obtain a homogenous mixture of aggregate and additives in the blending and mixing process. These problems arise from inconsistent flow of the aggregate, dry additives and liquid additives into the mixing chamber as well as changes in the mass balance of the mixing chamber. Resulting mixtures are not homogenous, thereby producing an undesirable finished product. In part, the inconsistent flow can be attributed to the difficult process of dispensing solid matter in a steady-state fashion. The discrepancies in the mixtures are accentuated in the portable mixing plant by the rugged nature of the terrain where the plant is normally used. The general presumption in the present versions of the portable mixing plant is of a steady-state model in the mixture process, but the present day control systems are not designed to handle the transient dynamic models that constitute the actual mixing process.

Prior art attempts to solve this problem have involved volumetric metering of the aggregate or the additives. One such device is a plant made and sold by Aran of Wacol, Brisbane, Australia under the name Aran ASR Continuous Mixing 280C. Although such techniques provide some improvement in the final product consistency, they are difficult to use in practice and are quite cumbersome to transport. There thus remains a long-felt need to overcome these and other problems associated with such plants.

BRIEF SUMMARY OF THE INVENTION

It is therefore a primary object of the present invention to provide a mobile pugmill that consistently produces a homogenous product.

It is another more general object of the invention to provide a transportable vehicle for blending and mixing aggregate and additives with a high degree of accuracy.

It is still another object to provide a highly portable, unitized pugmill that mixes products using a specialized weight-dependent metering system instead of known volumetric metering systems.

It is a further object of the invention to provide a vehicle that includes a feeder, mixer, silo, metering system and discharge conveyor all mounted on a tandem axis chassis. A programmable logic controller cooperates with weigh belt feeders to continuously measure and selectively control the amounts of feed material, additive and water that are combined in the mixer.

The present invention overcomes the inconsistencies of prior art plants by incorporating changes in gauging the mass flow rate of the aggregate and the dry additive feeders. Belt scales are used to obtain a more accurate reading of the mass of solids. A signal containing the present aggregate mass flow rate is then fed into a process control system that regulates the aggregate mass flow rate. The dry additive mass flow is based on the same system but is integrally linked to the weight percentage of the current aggregate flow rate instead of the ideal aggregate selected set point. A liquid flow meter is installed to measure the fluid flow of the liquid additive used. A proportional controller is used to control the fluid flow to the weight percentage amount of the actual aggregate flow as specified by the liquid set point. This ensures that the proper proportion of additives will be mixed with the aggregate even if the aggregate flow rate suffers from peaks or drops that will eventually be compensated by the aggregate controller.

The foregoing has outlined some of the more pertinent objects of the present invention. These objects should be construed to be merely illustrative of some of the more prominent features and applications of the invention. Many other beneficial results can be attained by applying the disclosed invention in a different manner or modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

DETAILED DESCRIPTION

Figure 1:
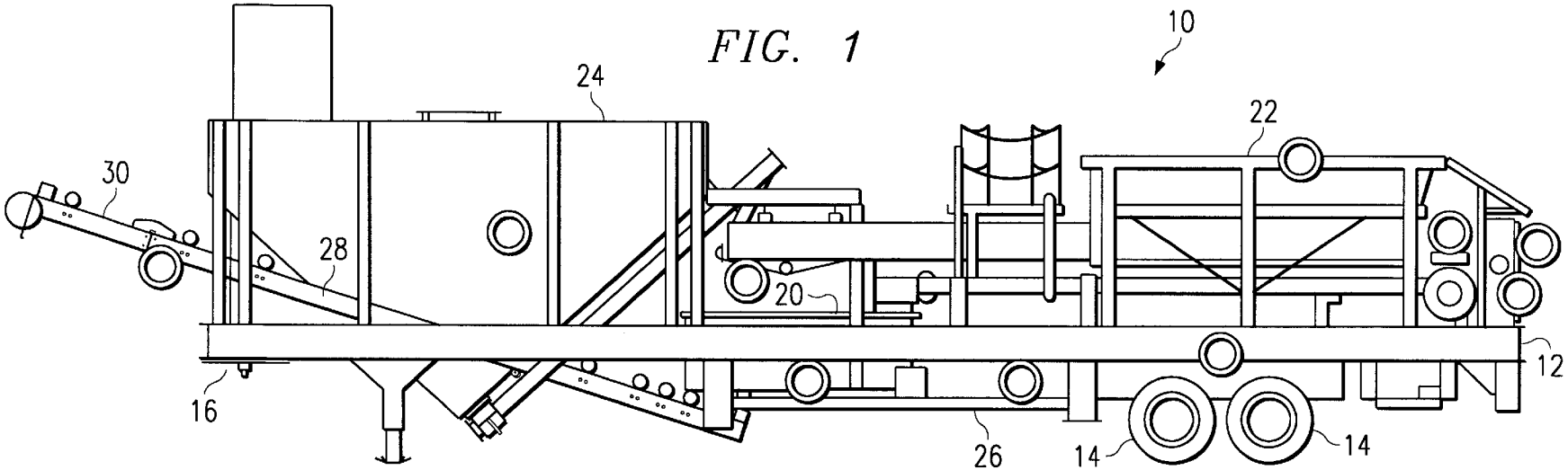
FIG. 1 is an elevational view of the inventive pugmill supported on a vehicle frame.

Referring to FIG. 1, the inventive vehicle 10 includes an elongated vehicle frame 12. Transport wheels 14 are provided at one end of the frame, typically the back end, to enable the vehicle to be transported. The opposite end, typically the forward end, includes a hitch 16 that is connectable to a conventional hitch structure at the rear of a drawing vehicle or tractor (not shown) to ready the vehicle for transport over a road. Although not meant to be limiting, the frame is approximately 50 feet in length and is a tandem axis chassis with an air ride suspension (not shown).

The pugmill includes several main components: a mixer 20, an aggregate feed system 22, a dry additive feed system 24, a liquid feed system 26 and a front discharge conveyor 28. In operation, aggregate supplied from the aggregate feed system 22 is mixed in the mixer 20 with a dry additive supplied from the dry additive feed system 24 and a liquid supplied from the liquid feed system 26. The resulting product is then removed from the plant via the front discharge conveyor 28. Conveyor 28 includes a foldable end portion 30 to reduce the length thereof during transportation of the vehicle. Thus, the inventive pugmill includes two different feed systems (one for the aggregate and one for the dry additives) on the same chassis, as well as a novel weighing system for controlling the metering of the various feeds into the mixer 20.

Figure 2:
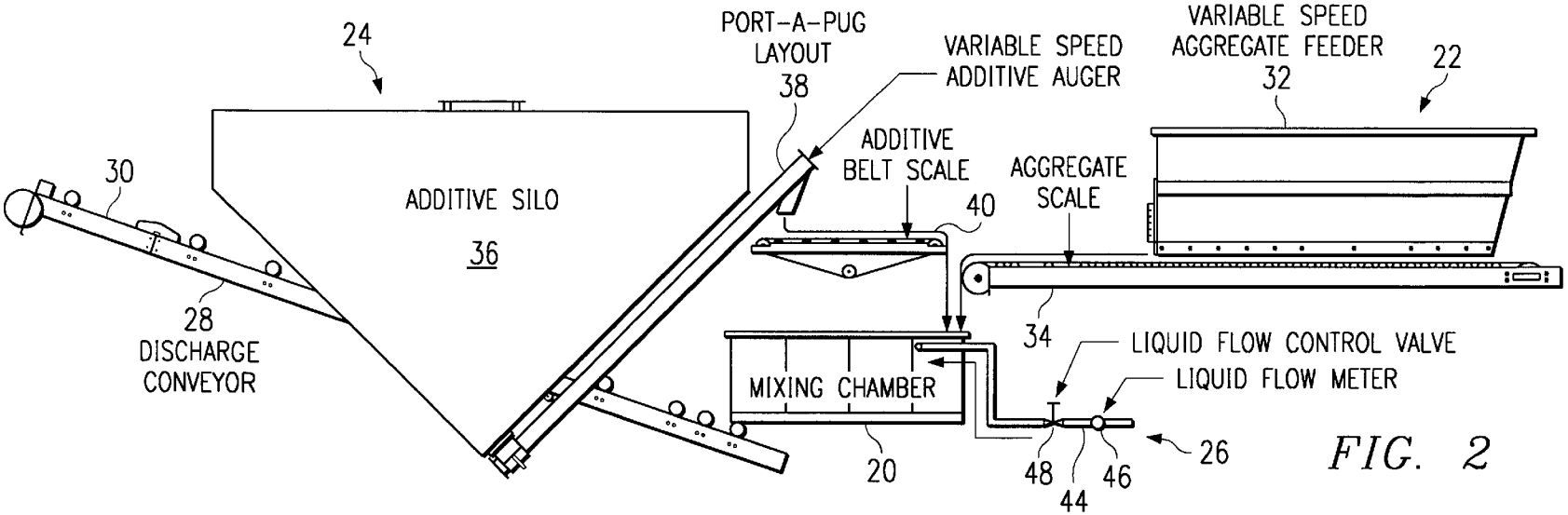
FIG. 2 is a more detailed view of the various components of the pugmill of FIG. 1.

Referring now to FIG. 2, a more detailed description of the pugmill feed and mixing operations can be seen. Aggregate feed system 22 comprises a variable speed aggregate feeder 32 supported adjacent an aggregate scale 34. The relative positions shown are merely exemplary, and other orientations may be used. Aggregate supported in the feeder 32 is supplied onto the scale 34 where it is weighed and also conveyed toward the mixer 20, which in the preferred embodiment is located in the approximate center of the pugmill. Dry additive feed system 24 comprises an additive silo 36 having an output that feeds into an upwardly-inclined variable speed additive auger 38. Again, the particular orientation of these devices is merely exemplary. Additive supplied from the silo 36 is delivered along the auger 38 and deposited on an additive belt scale 40, where it is weighed. From the additive belt scale 40, the additive is delivered into the mixer 20. The mixer 20 also receives a liquid from the liquid feed system 26 comprising a conduit 44, liquid flow meter 46 and liquid flow control valve 48. Liquid is delivered from a source (not shown) connected to the conduit 44.

As will be appreciated, each of the component feed systems includes some means for varying the rate at which the constituent supplied thereby is metered into the mixing chamber. Thus, the aggregate feed system includes the variable speed feeder 32, the dry additive system includes variable speed auger 38, and the liquid feed system includes liquid flow control valve 48. Other equivalent flow rate metering devices or apparatus may be substituted within the spirit and scope of the invention. Thus, as one example, aggregate feed system 22 could incorporate a hopper that deposits the aggregate onto a variable speed auger that in turn deposits the aggregate onto a weigh scale. Each of aggregate and additive metering devices is selectively controlled by the weight of material being supplied (as opposed to its volume) using a metering control system that receives inputs from the belt scales. This operation is now described.

Figure 3:
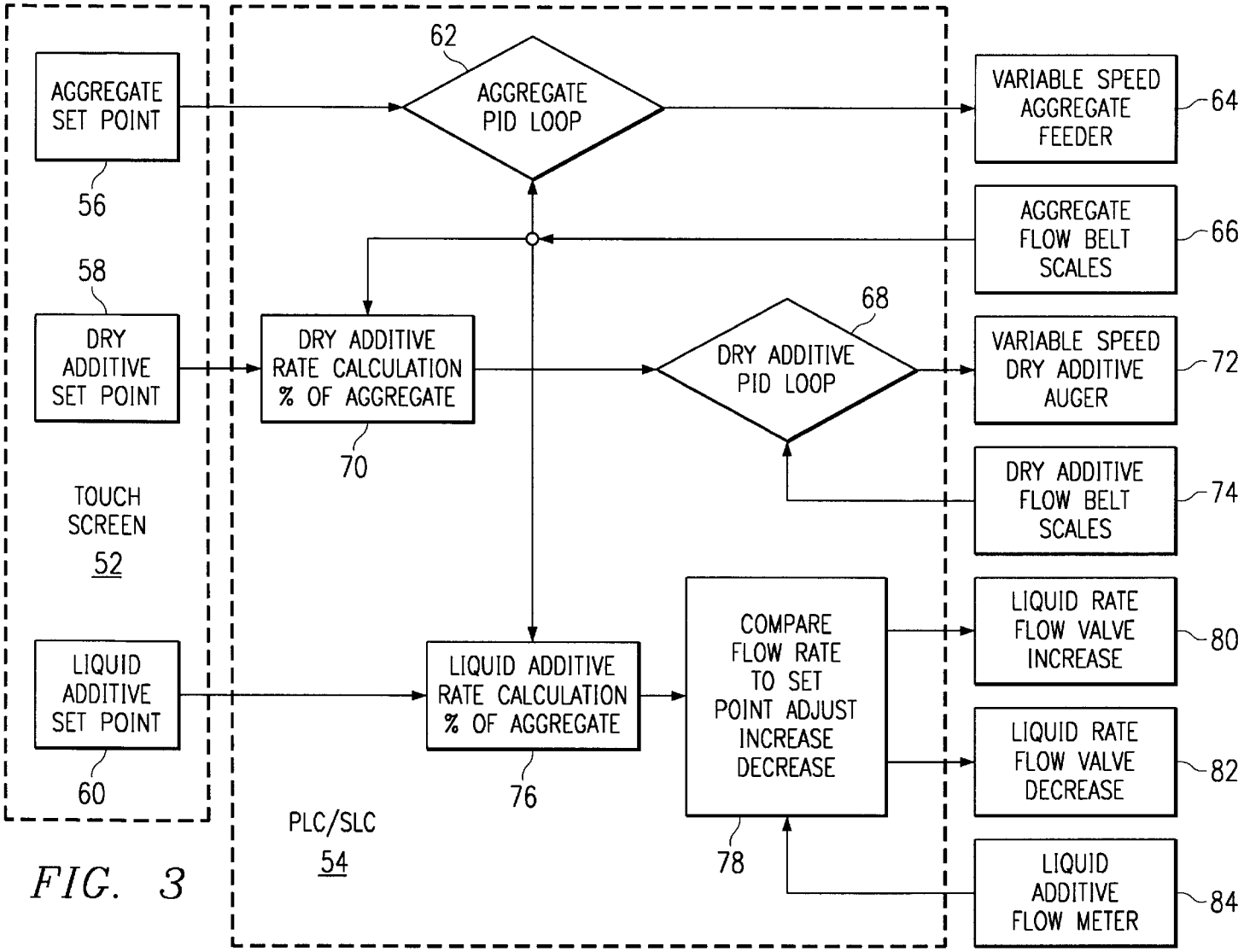
FIG. 3 is a diagram illustrating the metering control system of the inventive.

Turning to FIG. 3, the inventive control system 50 includes an input device 52, such as a touch screen having a display and keyboard, and a programmable logic controller 54. The touch screen 52 allows the user to establish a number of "set" points including an aggregate set point 56, a dry additive set point 58, and a liquid additive set point 60. Aggregate set point 56 establishes the mass flow rate (lbs/hr) for the aggregate. Dry additive set point 58 establishes the mass flow rate (lbs/hr) for the additive, and the liquid set point 60 establishes the liquid flow rate for the liquid. The programmable logic controller 54 continually monitors the set points and compares them with actual flow conditions to provide real-time control over mixing conditions by selectively varying one or more of the flow rate variables.

In particular, the aggregate set point is monitored in the programmable logic controller ("PLC") 54 by an aggregate proportional-integral-derivative ("PID") loop 62. The loop 62 monitors an electrical signal from the aggregate belt scale sensor 66 to thereby gauge the flow rate of aggregate from the feeder. To adjust the flow of the aggregate, the aggregate PID loop 62 sends a first control signal to a variable speed driver device 64 that controls the aggregate feeder.

The dry additive also includes its own PID loop 68 that receives two inputs, an electrical signal proportional to flow rate of the dry additive through the additive feed system (as determined by the weight of the additive on the belt scale 40), and a dry additive rate calculation 70 based on the dry additive set point 58 and a value derived from the aggregate flow rate. For example, if the signal from the aggregate belt scale indicates a mass flow rate of 200,000 lbs/hr. and the percentage is set at 2.5% (0.025 * 200,000 lbs/hr=5000 lbs/hr of dry additive), the dry additive flow rate will be 5000 lbs/hr. This calculation is controlled by the dry additive PID loop 68 that monitors signals from the dry additive belt scale sensor 74 to determine any necessary control process changes to implement in the flow. If such a change is calculated, a signal 72 is sent to the variable speed screw auger to increase or decrease speed to reach the desired additive flow.

The liquid additive set point 60 is established at a weight percentage selection of the aggregate flow rate. The calculation of the liquid flow rate 76 is conducted by determining the weight percentage of the aggregate flow. The aggregate flow per time segment is determined from a calculation covering the aggregate flow rate and a weight of liquid per time segment which is then divided by the density of the liquid to determine a liquid measure per time segment flow for the liquid additive (for example, the aggregate flow rate is 200,000 lbs/hr., the liquid set point is 5.0%, 5% of 200,000 is 10,000, the liquid being used weighs 8.3 lbs/gal, 10,000/8.3 equals 1205 gal/hr, 1205/60=20 gal/min., this is recalculated every program scan). This set point rate is then compared 78 to the actual flow rate from the liquid flow meter 84. If the actual rate is less than the desired rate the PLC will adjust the rate flow valve in the open direction 80, or if the actual rate is higher than the desired rate, the liquid flow control valve will be adjusted in the closed direction 82.

One skilled in the art will appreciate that the above-described control system is flexible and may easily be adapted to handle several dry and at least two liquid additive sources. Thus, for example, where a second dry additive is used, an auxiliary silo is provided along with an additional weigh scale. The onboard PLC controller is then adapted to use a PID loop as previously described to facilitate control over the amount of the second dry additive metered into the mix.

Although the present invention is preferably implemented with the programmable logic controller, it should be appreciated that the metering control system may be hardwired or implemented as a computer program running on a personal computer or the like. One of ordinary skill in the art would also recognize that all or parts of such methods may be carried out in hardware, in firmware, or in more specialized apparatus constructed to perform the required method steps.

The present invention is especially advantageous for the production of soil remediation, stabilized soils, roller compacted concrete and cold mix asphalt. The device is a highly portable, unitized pugmill that is capable of mixing products with a high degree of accuracy. The mill includes a feeder, mixer, solo, measurement system and discharge conveyor all mounted on a single tandem axis chassis. All that is needed for the operation is water and a source of power for the control system. The programmable logic controller and weigh belt feeders measure and control the amounts of feed material, additive and water.

What is claimed is:

1. A method of controlling a blending and mixing plant comprising the steps of:

a) providing an ideal aggregate flow rate;

b) providing an ideal additive percentage set point;

c) sending the ideal aggregate flow rate to an aggregate process controller;

d) receiving a current aggregate flow rate signal from an aggregate sensor;

e) comparing the ideal aggregate flow rate to the current aggregate flow rate in the aggregate process controller;

f) calculating the ideal additive flow rate from the additive percentage set point and the current aggregate flow rate;

g) changing the current aggregate flow rate by sending an aggregate output signal from the aggregate process controller to an aggregate dispenser;

h) sending the ideal additive flow rate to an additive process controller;

i) receiving a current additive flow rate signal from an additive sensor;

j) comparing the ideal additive flow rate to the current additive flow rate in the additive process controller;

k) changing the current additive flow rate by sending an output signal from the additive process controller to an additive dispenser; and l) repeating steps c–k at predetermined intervals.

2. The method of controlling a blending and mixing plant in claim 1 wherein the additive is a dry additive.

3. The method of controlling a blending and mixing plant in claim 2 wherein the additive sensor is a belt scale sensor.

4. The method of controlling a blending and mixing plant in claim 2 wherein the additive process controller is a proportional integral derivative controller.

5. The method of controlling a blending and mixing plant in claim 1 wherein the additive is a liquid additive.

6. The method of controlling a blending and mixing plant in claim 5 wherein the additive sensor is a flow meter.

7. The method of controlling a blending and mixing plant in claim 5 wherein the additive process controller is a proportional controller.

8. The method of controlling a blending and mixing plant in claim 1 wherein the aggregate process controller is a proportional integral derivative controller.

9. The method of controlling a blending and mixing plant in claim 1 wherein the aggregate sensor is a belt scale sensor.

* * * * *